United States Patent [19]

Gonzalez et al.

[11] 3,944,268

[45] Mar. 16, 1976

[54] SECURITY CHAIN LOCK

[75] Inventors: David A. Gonzalez; Odette A. Peacock, both of Hollywood, Calif.

[73] Assignee: The Raymond Lee Organization, Inc., New York, N.Y. ; a part interest

[22] Filed: Jan. 7, 1975

[21] Appl. No.: 539,162

[52] U.S. Cl. ..... 292/264

[51] Int. Cl.[2] ..... E05C 17/36

[58] Field of Search ..... 292/251, 264, 149, 105, 292/206; 151/69

[56] References Cited

UNITED STATES PATENTS

| | | | |
|---|---|---|---|
| 1,876,640 | 9/1932 | Dobson | 151/69 |
| 3,155,410 | 11/1964 | North et al. | 292/264 |

FOREIGN PATENTS OR APPLICATIONS

| | | | |
|---|---|---|---|
| 18,299 | 4/1899 | United Kingdom | 292/149 |
| 21,543 | 10/1898 | United Kingdom | 292/149 |

*Primary Examiner*—Richard E. Moore

*Attorney, Agent, or Firm*—Howard I. Podell

[57] ABSTRACT

A security stop lock for a door chain. The security stop lock is in the form of a joined pair of discs together with a thumb screw. The discs fit about the slot in the locking plate in a door chain mechanism and the thumb screw fastens the discs into a threaded hole in the member to which the slotted locking plate is fitted so as to prevent removal of the door chain tab from the slot of the locking plate.

2 Claims, 4 Drawing Figures

SECURITY CHAIN LOCK

SUMMARY OF THE INVENTION

Our invention is a security stop lock for a door chain. The security stop lock is in the form of a joined pair of discs together with a thumb screw. The discs fit about the slot in the locking plate in a door chain mechanism and the thumb screw fastens the discs into a threaded hole in the member to which the slotted locking plate is fitted so as to prevent removal of the door chain tab from the slot of the locking plate.

BRIEF DESCRIPTION OF THE DRAWING

The objects and features of the invention may be understood with reference to the following detailed description of an illustrative embodiment of the invention, taken together with the accompanying drawings in which.

DESCRIPTION OF THE PREFERRED EMBODIMENT

Figure 1:
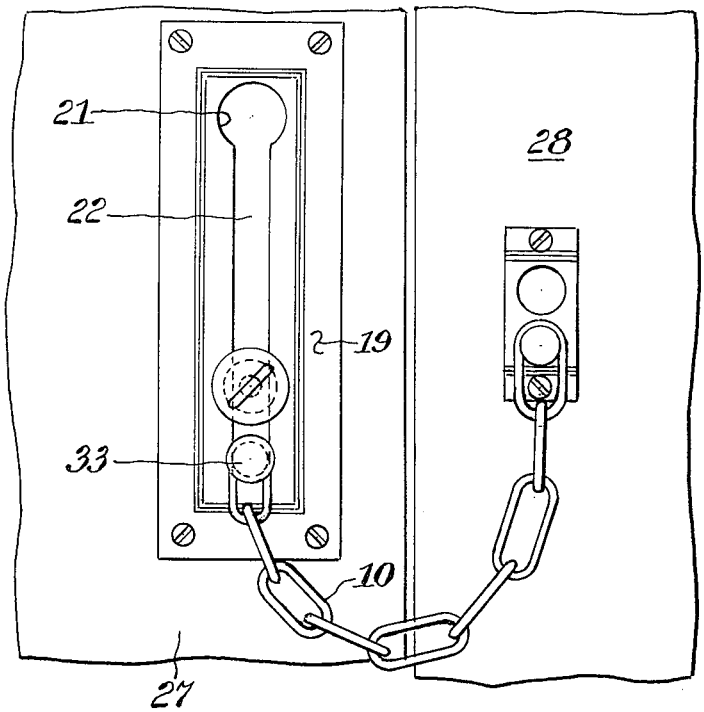
FIG. 1 illustrates an elevation view of the invention in use.
Figure 4:
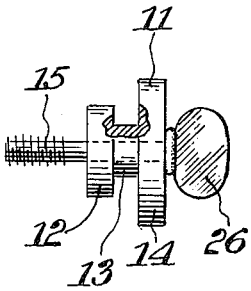
FIG. 4 is a side view of the stop lock and thumb screw.
Figure 2:
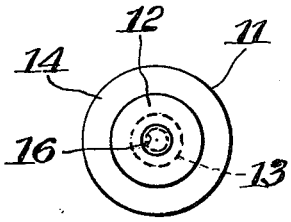
FIG. 2 is a rear view of the stop lock unit.
Figure 3:
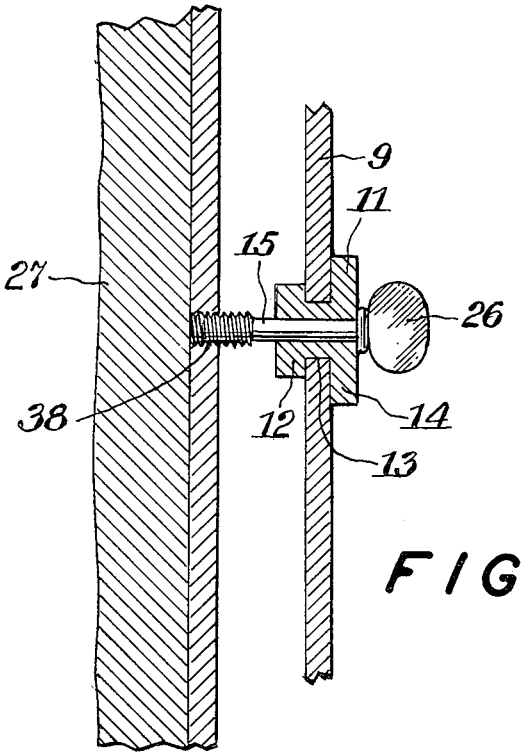
FIG. 3 is a fragmentary sectional view of the stop lock installer in a locking plate.

Turning now descriptively to the drawings, in which similar reference characters denote similar elements throughout the several views, FIG. 1 illustrates a conventional door chain mechanism 10 installed on a door 27 and door jamb 28, with the chain tab 33 held securely in the slot 22 of the locking plate 19 by stop lock 11.

As shown in FIGS. 1–4, the stop lock unit comprises a pair of discs 12 and 14 joined together by a reduced neck section 13, with a through central hole 16 in which a thumb screw 15 loosely rides. The door 27 or support member of the locking plate 19 is fitted with a blind threaded hole 38 open to inside face of the door and located opposite the slot 22 of the locking plate in a position between both ends of slot 22 in the locking plate 19.

Neck section 13 of the stop lock unit is of a lesser diameter than the width of slot 22 but of lesser diameter than the circular end opening 21 of slot 22, with the head disc 14 of a larger diameter than circular opening 21. Thumb screw 15 is fitted with a shaped head 26 of a size that may be readily gripped for tightening the stop lock 11 in place or for loosening screw 15 so as to remove the stop lock 11 from slot 22 when it is desired to remove the chain tab 33 from slot 22.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what we claim as new and desire to secure by Letters Patent of the United States is:

1. A stop lock unit for securing the chain tab of a chain lock mechanism in place in the slotted lock plate of a conventional door chain lock mechanism, so as to prevent opening of the door chain lock mechanism, comprising a conventional door chain lock mechanism with a lock plate that may be fastened to a door, said lock plate formed with a slot, one end of which is enlarged, and a chain that may be fastened to a door jamb, with the free end of the chain fastened to a tab member that may be inserted into the enlarged end of the slot of the lock plate and slid along the length of the slot, a stop lock unit adaptable for mounting in the said slot so as to prevent the tab member inserted in the slot from sliding past the installed stop lock unit, said stop lock unit being in the form of a pair of shaped plates joined by a reduced neck section and fitted with a through hole, together with a screw which loosely fits in said hole and is adaptable for engaging a threaded hole in the supporting member to which the lock plate is fastened behind the slot of the lock plate, when the stop lock unit is initially inserted into the enlarged end of the slot of the lock plate and then slid in the slot past the enlarged end, in which the neck of the stop lock unit is of lesser width than the width of the slot in the lock plate so as to ride freely in the slot, with the tail plate of the stop lock unit being of greater width than the width of the slot of the lock plate but of a size to fit through the enlarged end portion of the slot of the lock plate.

2. The combination as recited in claim 1 in which the head plate of the stop lock unit is shaped so that it will not pass through the enlarged end portion of the slot of the lock plate.

* * * * *